US007928305B1

(12) United States Patent
Chen

(10) Patent No.: US 7,928,305 B1
(45) Date of Patent: Apr. 19, 2011

(54) PEDAL SYSTEM FOR A PERCUSSION INSTRUMENT

(76) Inventor: Kuo Chang Chen, Taichung (TW)

( * ) Notice: Subject to any disclaimer, the term of this patent is extended or adjusted under 35 U.S.C. 154(b) by 0 days.

(21) Appl. No.: 12/635,546

(22) Filed: Dec. 10, 2009

(51) Int. Cl.
*G10D 13/02* (2006.01)

(52) U.S. Cl. ..... 84/422.1

(58) Field of Classification Search ..... 84/422.1, 84/422.3, 422.2
See application file for complete search history.

(56) References Cited

U.S. PATENT DOCUMENTS 7,579,540 B2 * 8/2009 Takegawa ..... 84/422.1
* cited by examiner

*Primary Examiner* — Kimberly R Lockett

(57) ABSTRACT

A pedal system for a percussion instrument includes a support element. The support element includes a pedal, at least one upright frame, a positioning unit and a rotatable axle. A connecting shank and a connecting body are disposed on the axle. A transmission element connects the pedal with the connecting shank. A resilient member has a first end and a second end. The first end of the resilient member is adjustably connected to the connecting body, and the second end of the resilient member is adjustably connected to the positioning unit. As such, the position of the resilient member is adjustable to provide different resilient force, modifying the pedal feedback.

8 Claims, 11 Drawing Sheets

PEDAL SYSTEM FOR A PERCUSSION INSTRUMENT

BACKGROUND OF THE INVENTION

1. Field of the Invention

The present invention relates to a percussion instrument, and more particularly to a pedal system for a percussion instrument.

2. Description of the Prior Art

Some of the conventional drum assemblies each includes a pedal system for the player to percuss the drum by foot. The pedal system is usually provided with a resilient means to retain the pedal at the release position while not stepped upon.

U.S. Pat. No. 5,365,824 discloses a pedal system having such resilient means, in which the height of a lower end of the resilient means is adjustable, so as to control the resilient force the resilient means provides.

SUMMARY OF THE INVENTION

The main object of the present invention is to provide a pedal system with different resilient means for modifying the pedal feedback.

To achieve the above and other objects, the pedal system of the present invention includes a support element, a connecting shank, a transmission element and a returning element. The support element has a pedal, at least one upright frame, a positioning unit and an axle. The connecting shank is disposed on the axle, and the transmission element connects the connecting shank with the pedal. The returning element includes a connecting body and a resilient member. The connecting body is disposed on the axle in a rotational operative relationship. The resilient member has a first end and a second end. The first end of the resilient member is adjustably connected to the positioning element, and the second end of the resilient member is adjustably connected to the connecting body. As such, the distance between each end of the resilient member and the axle is adjustable, so as to modify the pedal feedback.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
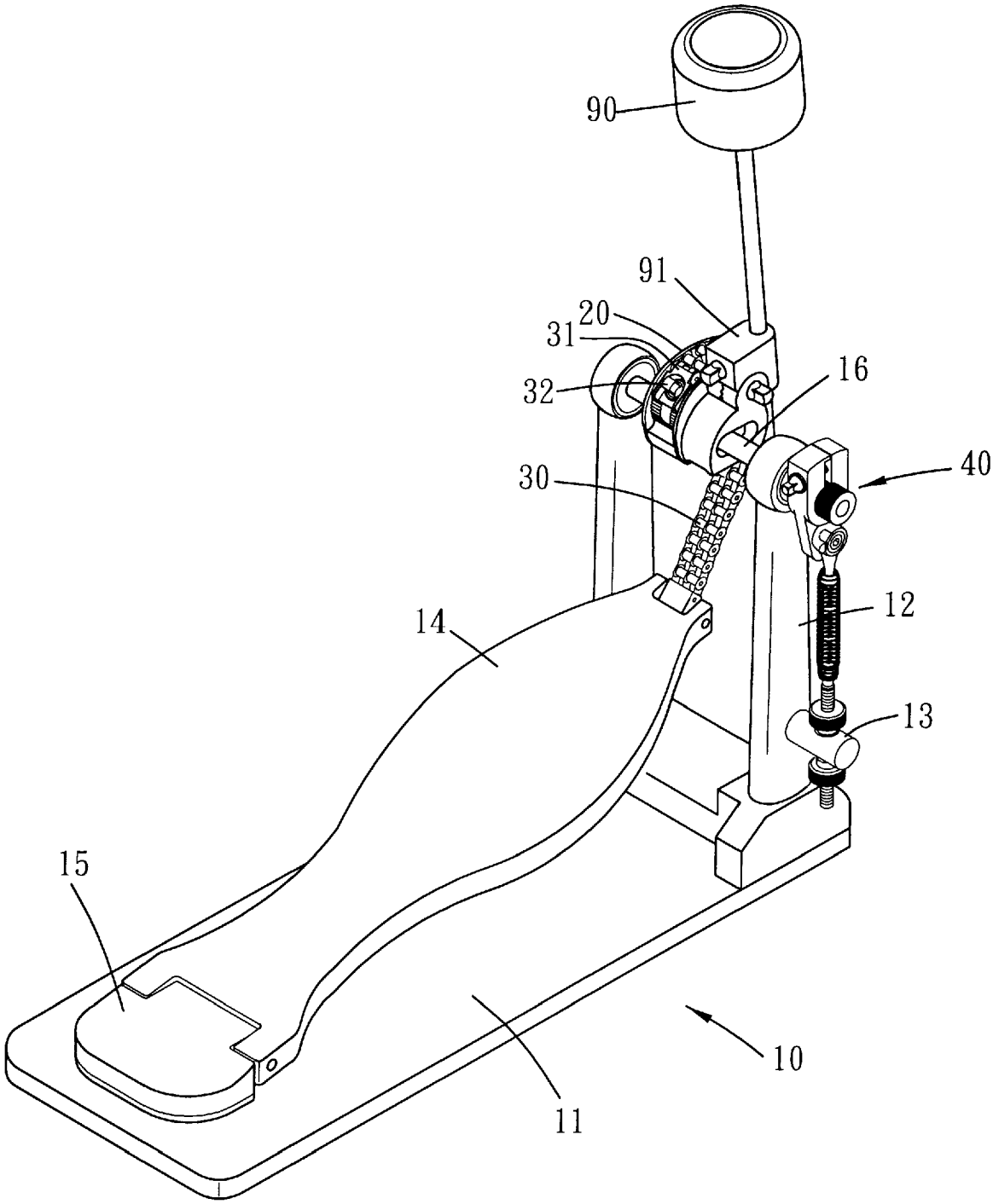
FIG. 1 is a perspective view showing a pedal system of the present invention.

Please refer to FIG. 1. A pedal system may be provided with a drum hammer 90 to percuss a percussion instrument, such as a drum.

The pedal system includes a support element 10, a connecting shank 20, a transmission element 30 and a returning element 40.

Figure 2:
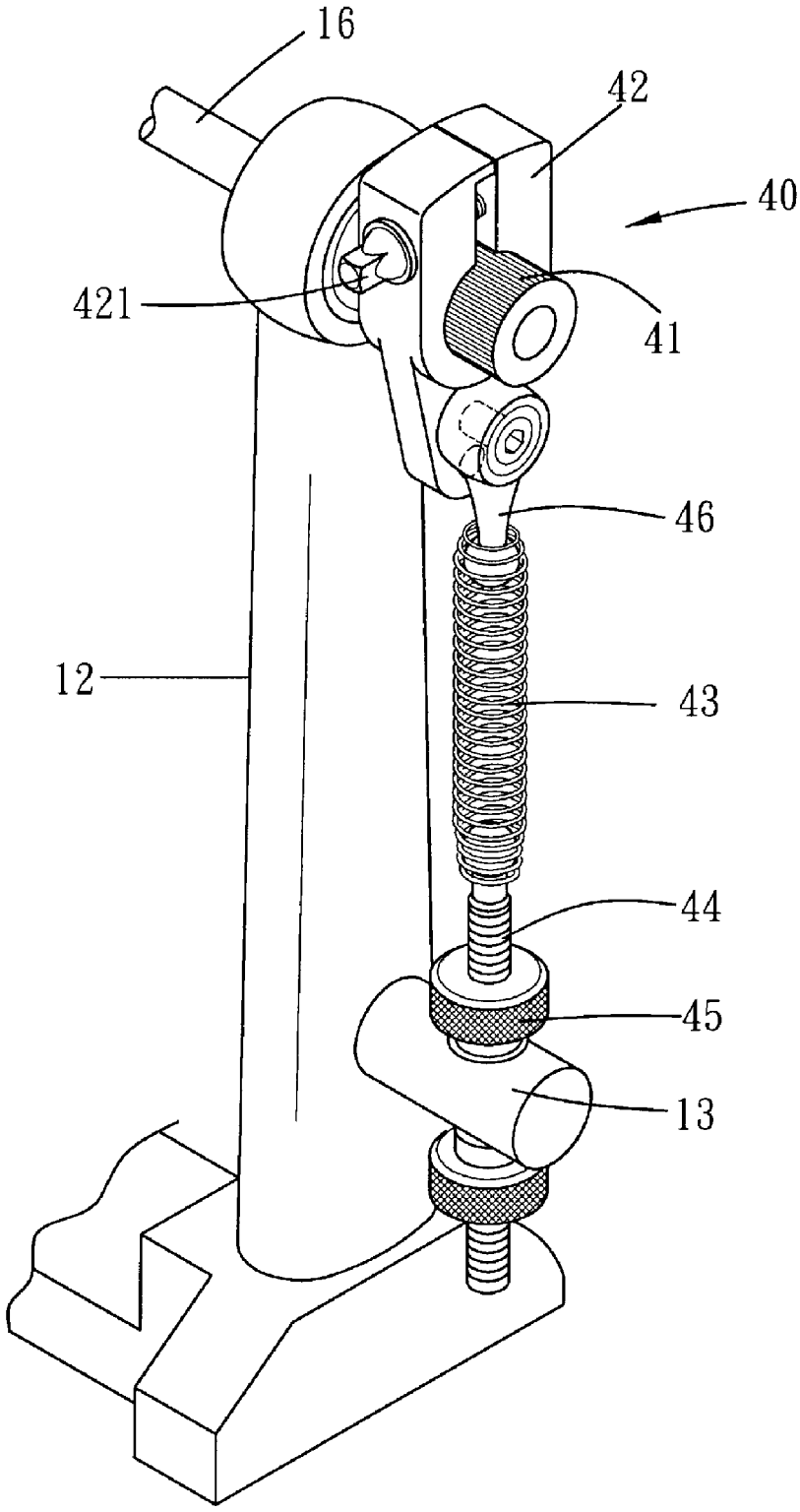
FIG. 2 is a partial enlarged drawing of FIG. 1.
Figure 3:
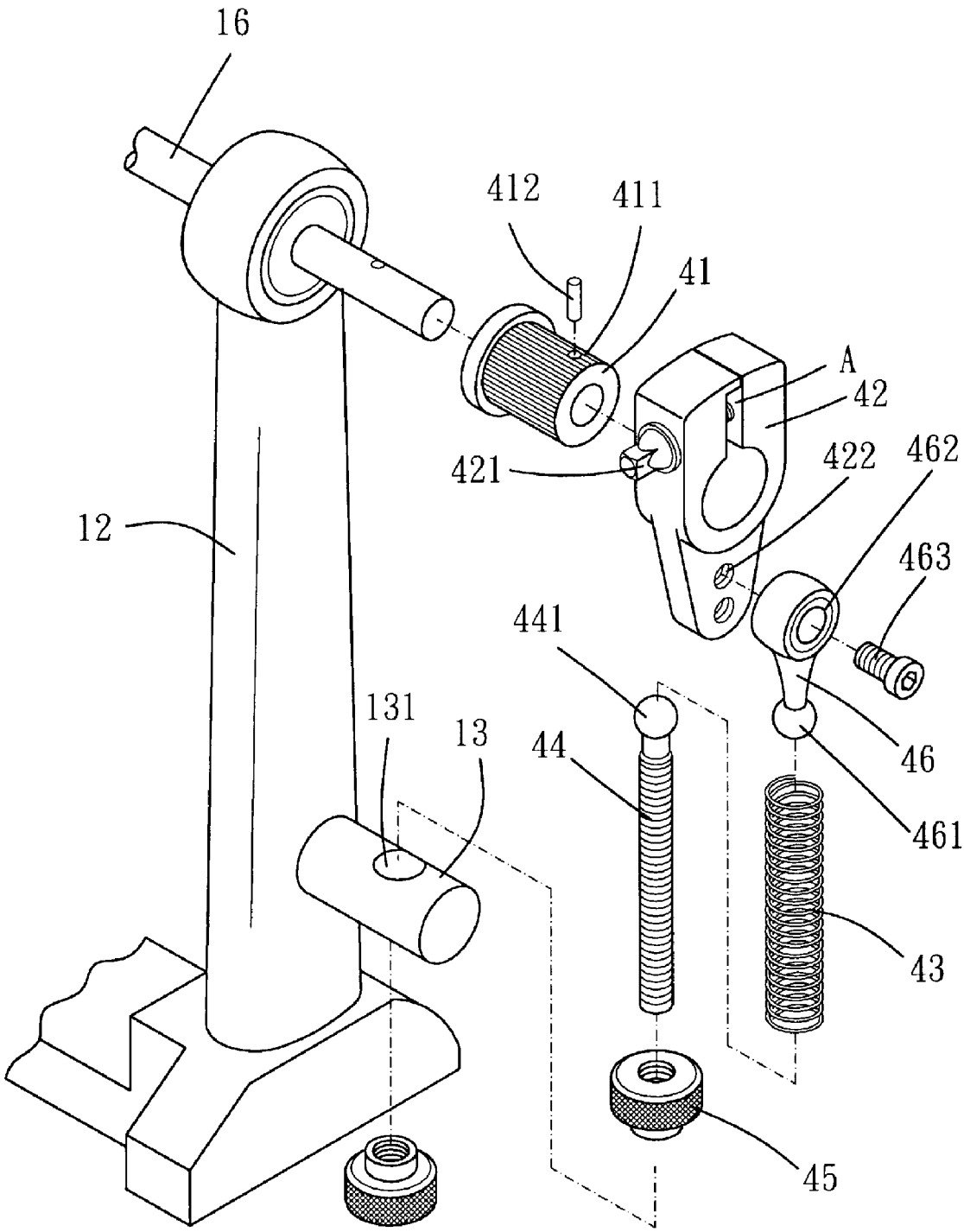
FIG. 3 is a partial breakdown drawing showing a pedal system of the present invention.

Please refer to FIG. 1 to FIG. 3. The support element 10 includes a pedal base 11, two upright frames 12 and a positioning unit 13. The upright frames 12 are installed at one end of the pedal base 11, while another end of the pedal base 11 pivots a pedal 14. Thus the pedal 14 is swayable between a release position and a percussion position. A pivoting plate 15 can be further provided to pivot the pedal 14 on the pedal base 11. The distal ends of the upright frames 12 are rotatably installed with an axle 16. Note that the axle 16 can also be supported by a single upright frame. The positioning unit 13 is disposed on one of the frames 12 and locates remote from the axle 16. The positioning unit 13 is formed with a through hole 13, as shown in FIG. 3. In other embodiments of the present invention, the positioning unit 13 may also be disposed on other positions of the support element 10.

The connecting shank 20 is disposed on the axle 16. In an embodiment of the present invention, the connecting shank may have a non-circular bore to sleeve around a non-circular section of the axle, so that the shank and the axle can be in a rotational operative relationship. In another embodiment of the present invention, the connecting shank has a circular bore to sleeve on the axle. The connecting shank can fixed on the axle in a threaded manner. As such, a rotational operative relationship between the shank and the axle can also be achieved.

The transmission element 30 can be a chain. The transmission element 30 has a fixation device at one end thereof. The fixation device includes a teeth body 31 and a threaded unit 32. The teeth body 31 has a plurality of teeth facing the connecting shank 20. The threaded unit 32 can be threadedly disposed on the connecting shank 20 such that the teeth body 31 can be urged to tightly abut against the shank 20. Another end of the transmission element 30 connects to the distal end of the pedal 14. As such, the pedal 14 and the transmission element 30 are in a motional operative relationship. Note that the transmission element may also be a belt or a connecting rod set. Other fixation device may also be provided to adjust the distance between the pedal and the connecting shank.

The returning device 40 includes a skidproofing sleeve 41, a connecting body 42, a resilient member 43, a threaded rod 4 and two nuts 45. Please refer to FIG. 2 and FIG. 3. The skidproofing sleeve 41 is substantially a short tube with grooves axially disposed around its outer periphery. The grooves may also be slightly slanted to the axis direction of the skidproofing sleeve 41. The sleeve 41 sleeves on the axle and has a fixation bore 411 for a pin 412 to insert therethrough, and a part of the pin 412 is then inserted in the axle. As such, the skidproofing sleeve 41 and the axle 16 are also in a rotational operative relationship. The connecting body 42 is substantially C-shaped and has an opening A. A screw 421 is mounted on the connecting body 42 to narrow the opening A, so that the connecting body 42 can tightly clamp the skidproofing sleeve 41. A rotational operative relationship between the connecting body 42 and the axle 41 is, therefore, achieved.

The resilient member 43 has a first end and a second end. The first end of the resilient member 43 is adjustably connected to the positioning unit 13, so that a distance between the first end and the axle 16 can also be adjustable. More specifically, the threaded rod 44 inserts through the through hole 131 of the positioning unit 13, and the nuts 45 are mounted on the threaded rod 44 and locate at opposite sides of the positioning unit 13 to fix the height of the threaded rod 44. Note that the upper nut 45 is not absolutely necessary but is omittable. An upper end of the threaded rod 44 is formed with a ball 441 for the resilient member 43 to surround. In other embodiments of the present invention, the upper end of the threaded rod 44 may be formed with a bore for the resilient member to hook.

The second end of the resilient member 43 is adjustably connected to the connecting body 43 so that a distance between the second end and the axle 16 is adjustable as well. In the present embodiment, the connecting body 43 is formed with a plurality of inserting bores 422 arranged in a row along a radial direction of the axle 16. As such, a distance between each inserting bore 422 and the axle 16 is different from that between any other inserting bore and the axle 16. The second end of the resilient member 43 connects to an adjusting unit 46. The adjusting unit 46 can be formed with a ball 461 for the resilient member 43 to surround, or it can be formed with a hook bore for the resilient member 43 to hook. The adjusting unit 46 is further formed with a pin bore 462. A pin 463 is inserted through the pin bore 462 and then is inserted and threaded in one of the inserting bores 422. Thereby, the adjusting unit 46 is detachably disposed on one of the inserting bores 422. Also, the adjusting unit 46 is rotatable about an axis of the inserting bores 422 the pin 463 inserts through. In other embodiments of the present invention, the second end of the resilient member can be bent into a hook shape, and the hook-shaped second end can directly hook one of the inserting bores 422.

Figure 4:
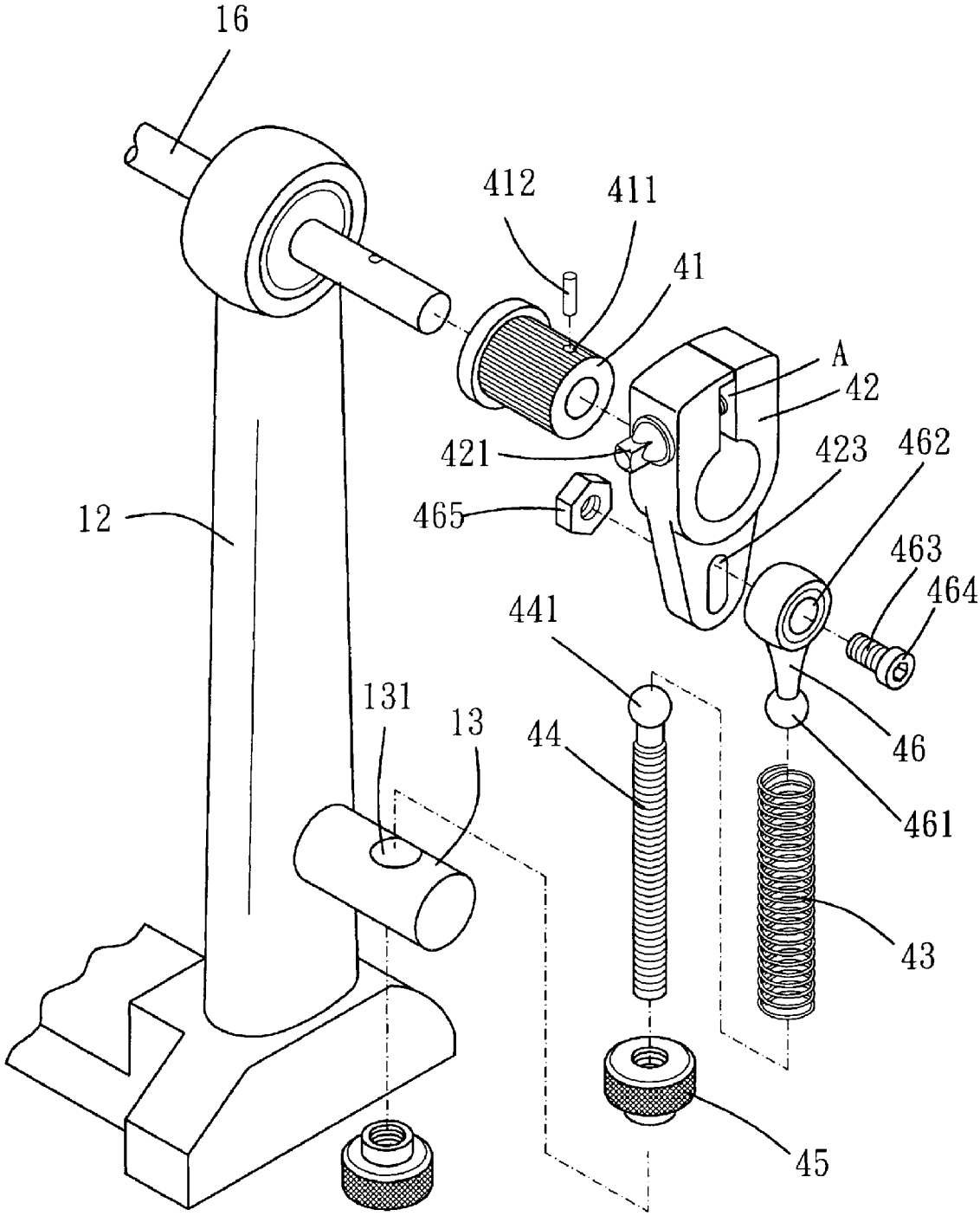
FIG. 4 is a partial breakdown drawing showing a pedal system with its connecting body having a slot.

Please refer to FIG. 4 for another embodiment of the present invention. The connecting body 42 is formed with a slot 423, which has a first end and a second end. A distance between the first end of the slot 423 and the axle 16 is different from that between the second end of the slot 423 and the axle 16. The pin 463 inserts through the pin bore 462 and then inserts in the slot 423. The pin 463 has a head portion 464 and a threaded portion extended from the head portion 464. A nut 465 is mounted on the threaded portion and selectively fixes the adjusting unit 46 on the connecting body 42. Thereby, the adjusting unit 46 is slidably connected to the slot 423 and is selectively fixed at a position between both ends of the slot 423.

Figure 5:
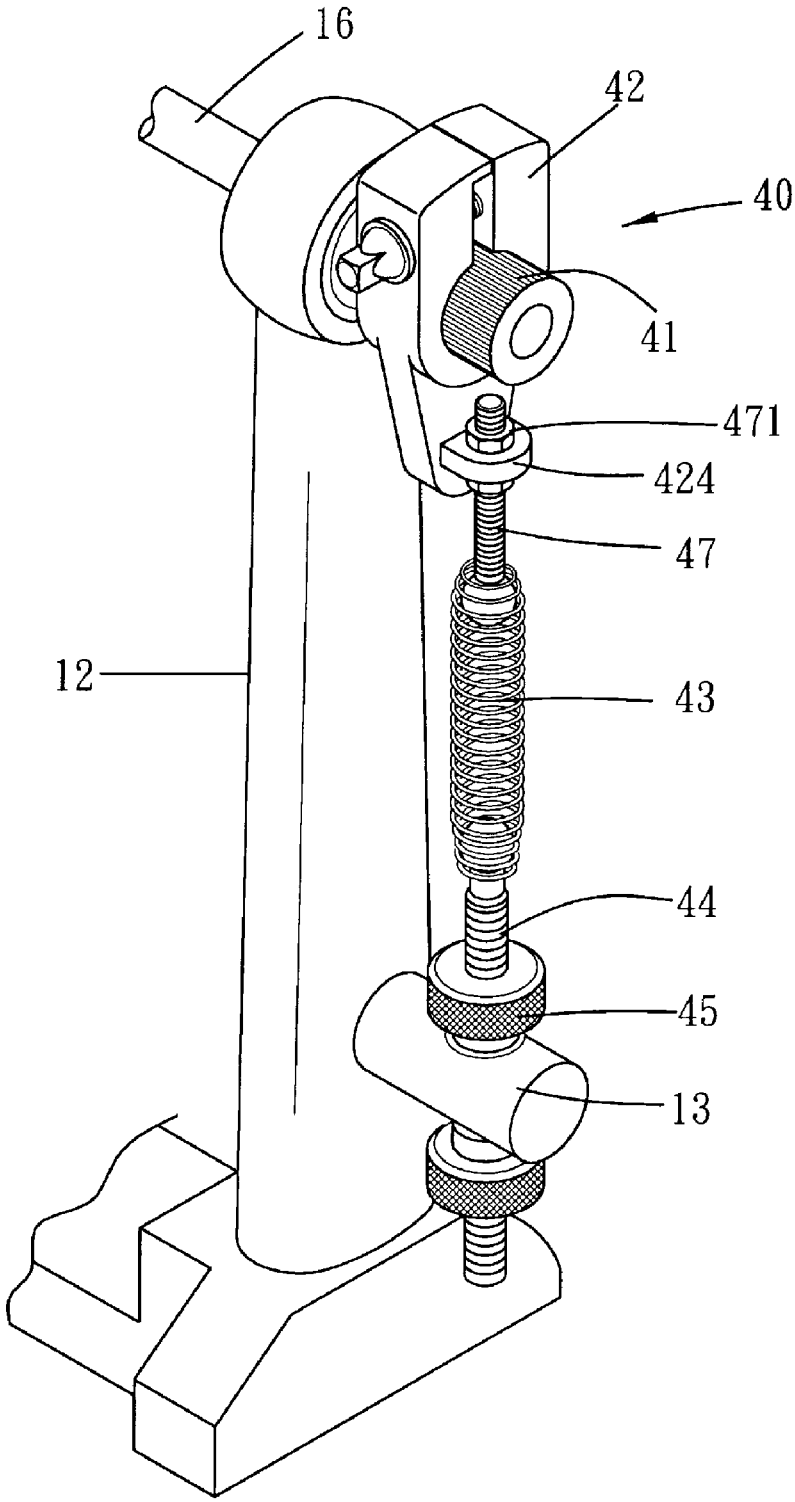
FIG. 5 is a partial perspective view showing a pedal system with its connecting body having an ear portion.
Figure 6:
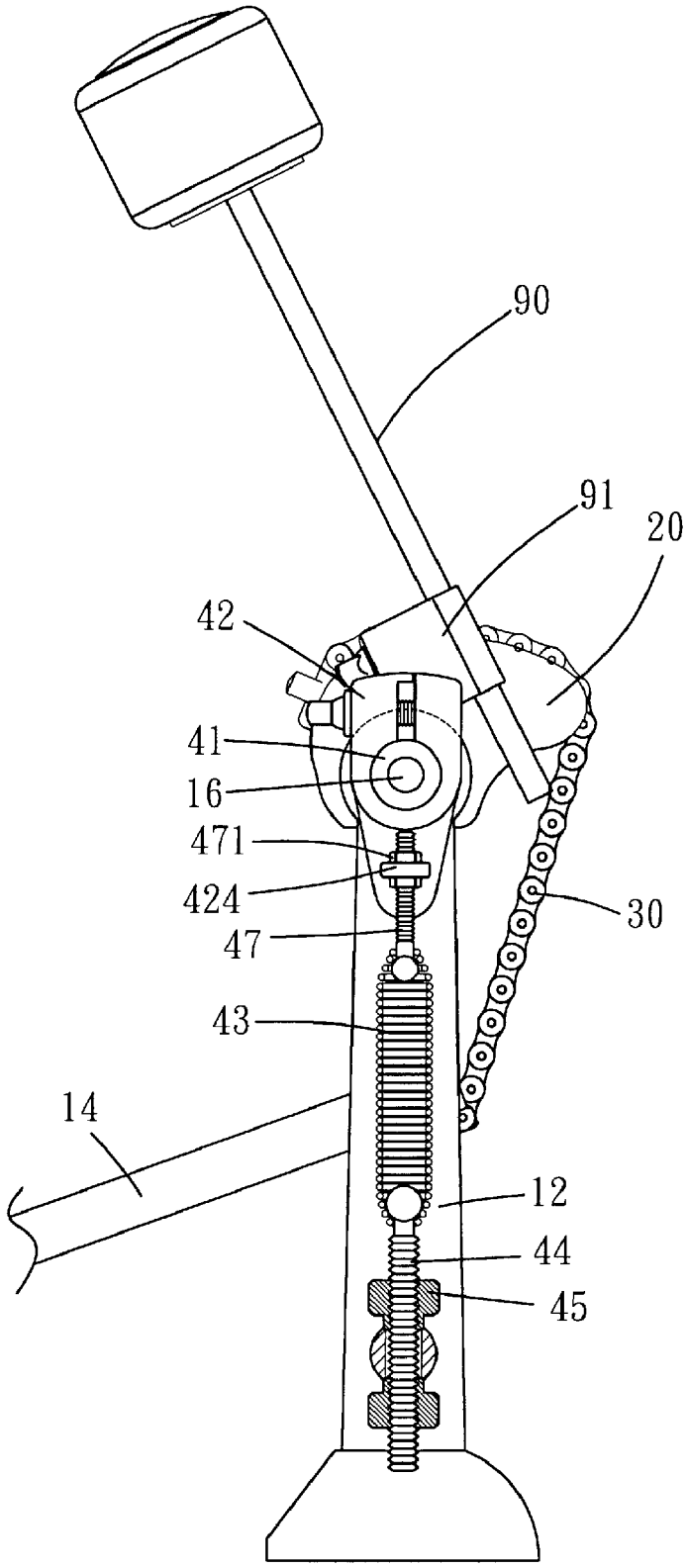
FIG. 6 is a partial lateral view showing a pedal system with its connecting body having an ear portion.

Please refer to FIG. 5 and FIG. 6 for yet another embodiment of the present invention. An ear portion 424 is extended from the connecting body 42. The ear portion 424 is formed with a through hole along a radial direction of the axle 16. Or the through hole may also be slanted to such radial direction. A threaded extension rod 47 inserts through the through hole. Two nuts 471 are mounted on the extension rod 47 and abut against the ear portion 424 and locate at opposite sides of the ear portion 424. As such, the height of the extension rod 47 is adjustable. Note that the lower nut 471 is not absolutely necessary but is omittable.

Figure 7:
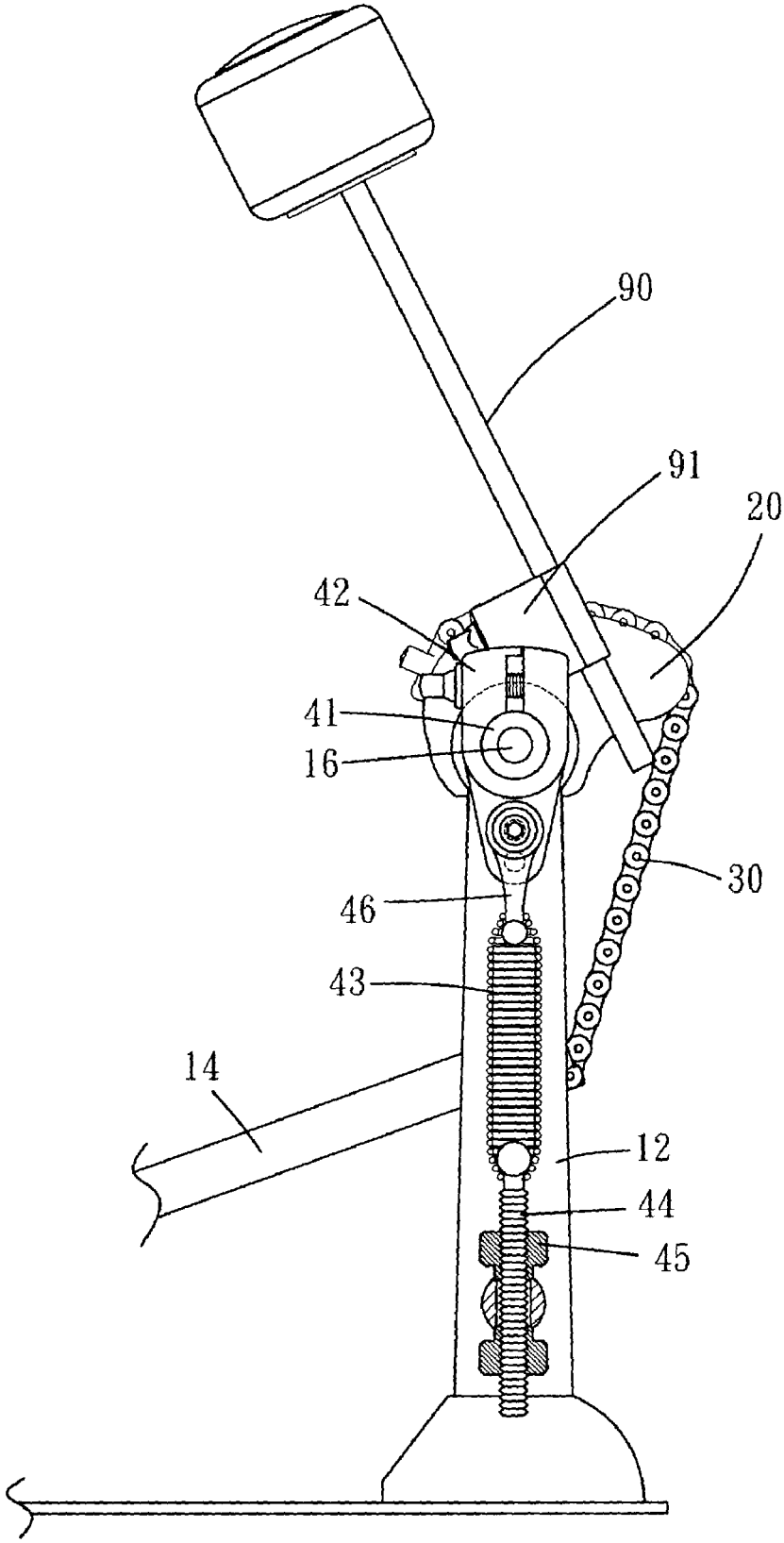
FIG. 7 is a partial lateral view showing a pedal system of the present invention.

Please refer to FIG. 1 and FIG. 7. Once the pedal system of the present invention is assembled, the pedal 14, the transmission element 30, the connecting shank 20, the axle 16, the connecting body 42 and the resilient member 43 are all in a motional operative relationship. The resilient member 43 is, therefore, provides a resilient force to retain the pedal 14 at the release position when the pedal 14 is not stepped upon. The axle 16 may be further provided with a hammer base 91 for the drum hammer 90 to install thereon. Note that the hammer 90 may also be directly installed on the connecting shank or the axle.

Figure 8:
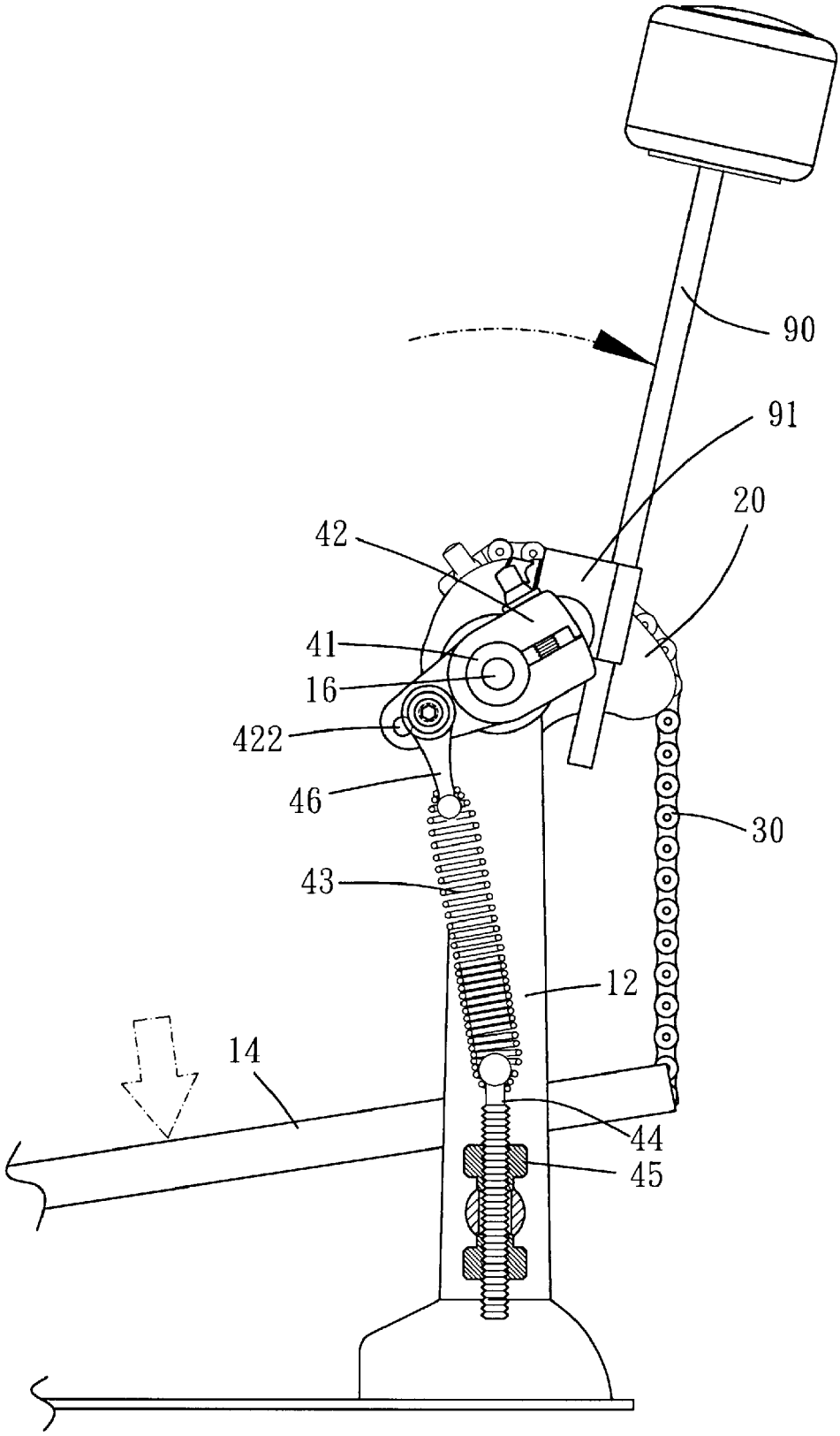
FIG. 8 is a partial lateral view showing a pedal system of the present invention.

Please refer to FIG. 8. The pedal 14 is stepped upon and moves to the percussion position, driving the hammer 90 to quickly sway in order to strike a percussion instrument. At this moment, the resilient member 43 is stretched and the resilient force accumulates as well. As such, a torque force is applied on the axle. Such torque force can drive the pedal 14 back to the release position once the pedal 14 is released, as shown in FIG. 7.

Figure 9:
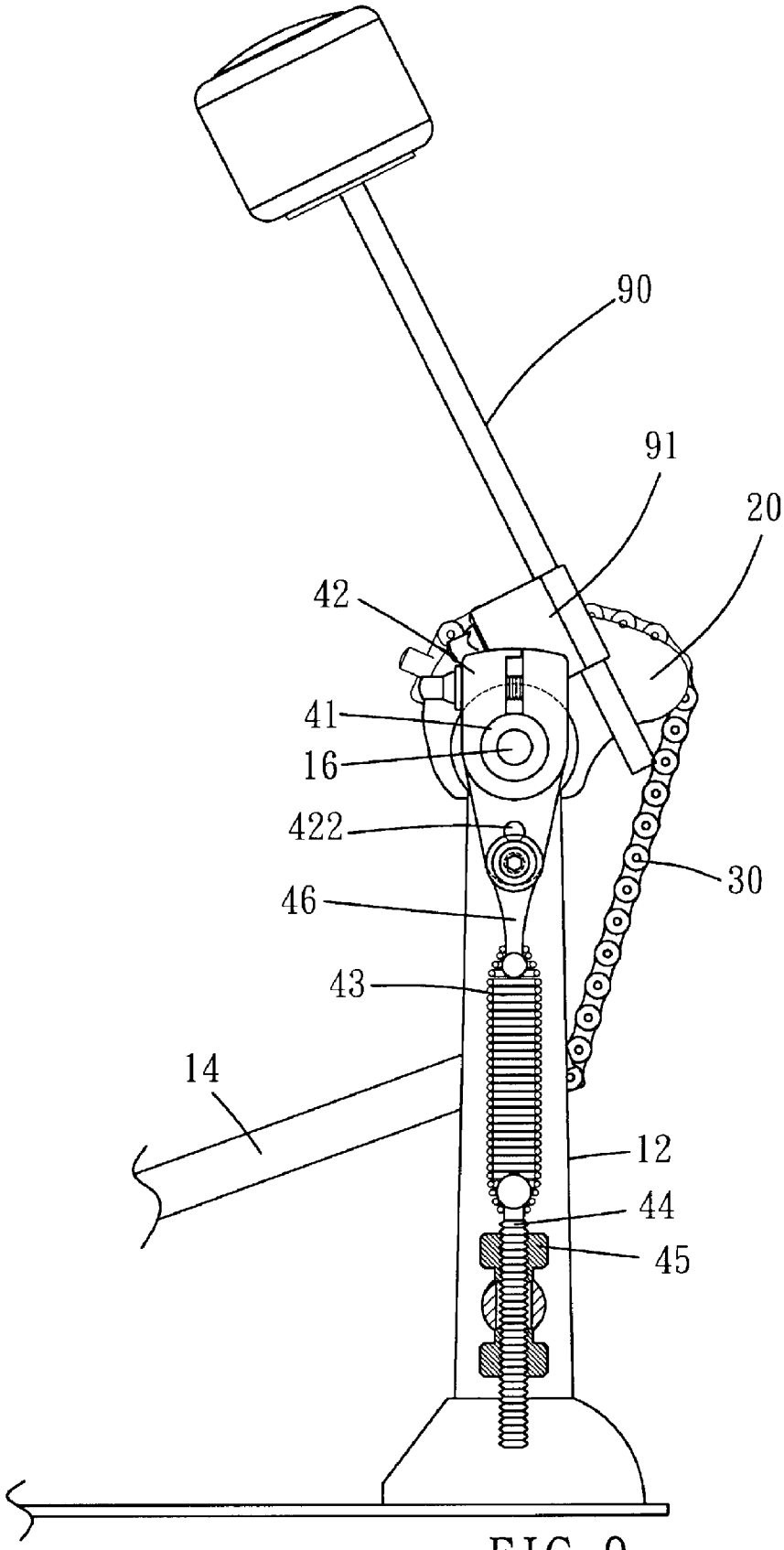
FIG. 9 is a partial lateral view showing a pedal system of the present invention.
Figure 10:
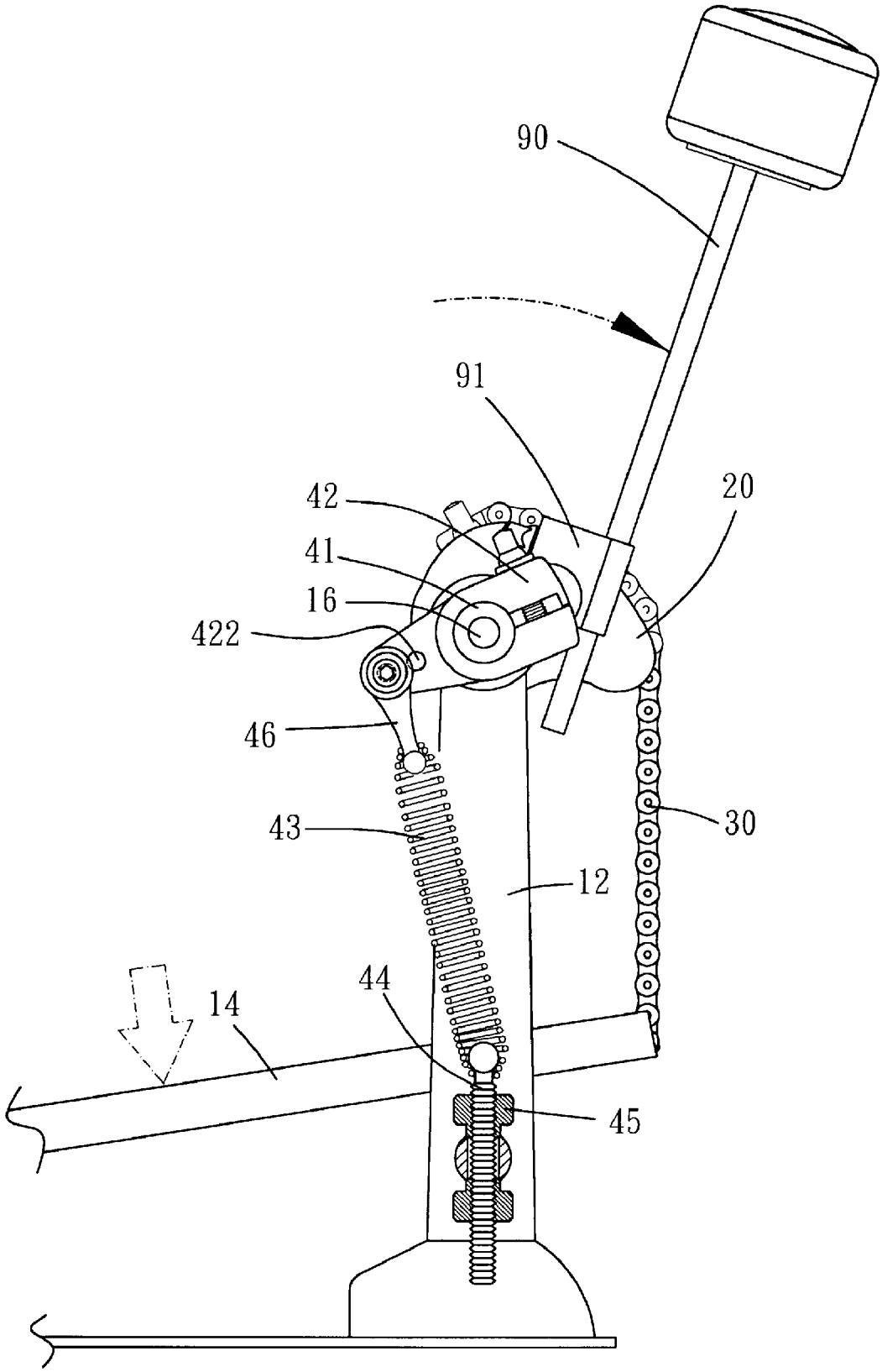
FIG. 10 is a partial lateral view showing a pedal system of the present invention.

Please refer to FIG. 9 and FIG. 10, both ends of the resilient member 43 are height-adjustable, so as to provide the axle 16 with different torque force and thus modify the pedal feedback the player gets.

Figure 11:
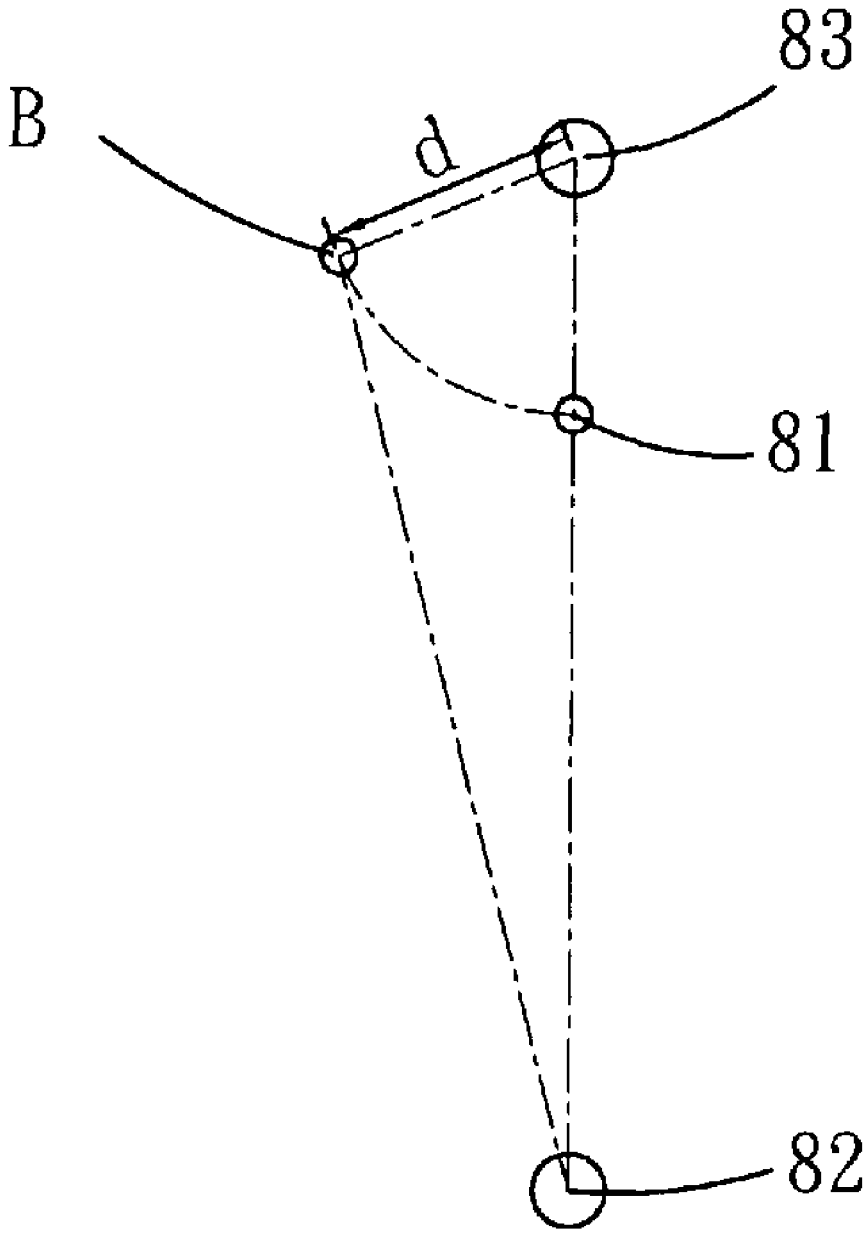
FIG. 11 is a schematic drawing showing a positional relation between the connecting body and the resilient member.

Please refer to FIG. 11 for a positional relation between the connecting body and the resilient member. The first point 81 is a joint section between the adjusting unit and the connecting body, the second point 82 is a joint section between the resilient member and the threaded rod, and the third point 83 is where the axle locates. As the pedal is stepped by the player, the first point 81 sways to the position B. Thus a torque force can be controlled by the length of the force arm d and a stretching length of the resilient member. The longer the stretching length is, the more the resilient force increases. In the present invention, the position of the first point 81 is adjustable, and that of the second point 82 is adjustable as well. Therefore, the length of the force arm and the stretching length of the resilient member are both controllable in the present invention. Accordingly, the torque force applied on the axle is controlled, so as to achieve a pedal feedback the player requires.

What is claimed is:

1. A pedal system for a percussion instrument, comprising:

a support element, having a pedal, at least one upright frame and a positioning unit, the pedal being swayable between a release position and a percussion position, an axle being rotatably disposed on the upright frame;

a connecting shank, disposed on the axle in a rotational operative relationship;

a transmission element, connecting between the pedal and the connecting shank, the connecting shank along with the axle being rotatable as the pedal pivoting between the release position and the percussion position; and a returning element, comprising a connecting body and a resilient member, the connecting body being disposed on the axle in a rotational operative relationship, the resilient member having a first end and a second end, the first end of the resilient member being adjustably connected to the positioning unit, and a distance between the first end and the axle being adjustable, the second end of the resilient member being adjustably connected to the connecting body, and a distance between the second end and the axle being adjustable as well.

2. The pedal system of claim 1, wherein the connecting body is formed with a plurality of inserting bores, a distance between each inserting bore and the axle is different from that between any other inserting bore and the axle, the second end of the resilient member is detachably connected to one of the inserting bores.

3. The pedal system of claim 2, further comprising an adjusting unit, the adjusting unit being formed with a pin bore, a pin being inserted through the pin bore and then being inserted in one of the inserting bores, the second end of the resilient member being disposed on the adjusting unit.

4. The pedal system of claim 2, wherein the second end of the resilient member is formed in a hook shape, the hook-shaped second end of the resilient member hooks one of the inserting bores.

5. The pedal system of claim 1, wherein an ear portion is extended from the connecting body, the ear portion is formed with a through hole, a threaded extension rod inserts through the through hole, at least one nut is mounted on the extension rod and abuts against the ear portion, the second end of the resilient member is disposed on the extension rod.

6. The pedal system of claim 1, wherein the connecting body is formed with a slot, the slot has a first end and a second end, a distance between the first end of the slot and the axle is different from that between the second end of the slot and the axle; an adjusting unit being slidably connected to the slot and being selectively fixed at a position between both ends of the slot, the resilient member being disposed on the adjusting unit.

7. The pedal system of claim 6, wherein the adjusting unit is formed with a pin bore, a pin is inserted through the pin bore and then is inserted through the slot, the pin has a head portion and a threaded portion extended from the head portion, a nut is mounted on the threaded portion and selectively fixes the adjusting unit on the connecting body.

8. The pedal system of claim 1, wherein the positioning unit is formed with a through hole, a threaded rod inserts through the through hole of the positioning unit, at least one nut is mounted on the threaded rod and abuts against the positioning unit, the first end of the resilient member is disposed on the threaded rod.

* * * * *